US006459026B1

(12) United States Patent
Bozzio

(10) Patent No.: US 6,459,026 B1
(45) Date of Patent: Oct. 1, 2002

(54) DRUM TENSIONER HOLDING

(76) Inventor: Terry J. Bozzio, 2404 Yosemite Dr., Austin, TX (US) 78733

( * ) Notice: Subject to any disclaimer, the term of this patent is extended or adjusted under 35 U.S.C. 154(b) by 0 days.

(21) Appl. No.: 09/804,573

(22) Filed: Mar. 13, 2001

(51) Int. Cl.[7] ..... G10D 13/02
(52) U.S. Cl. ..... 84/411 R; 821/13; 821/411 A
(58) Field of Search ..... 84/411 R, 413, 84/421, 411 A

(56) References Cited

U.S. PATENT DOCUMENTS 4,596,176 A * 6/1986 Gauger ..... 84/421
5,404,786 A * 4/1995 Gatzen ..... 84/421
5,922,981 A * 7/1999 Ballister ..... 84/464 A

* cited by examiner

*Primary Examiner*—Shih-Yung Hsieh
(74) *Attorney, Agent, or Firm*—William W. Haefliger

(57) ABSTRACT

For combination with drum head tensioning structure, including a flange defining a through opening for passing a tensioner rod; a seating surface on the flange in close association with the opening, and a grommet sized to receive loading transmitted by the tensioner rod, and having a shoulder or shoulders engaging a seating surface to transmit loading to the flange, the grommet blocking loosening rotation of the tensioner rod relative to the flange.

13 Claims, 4 Drawing Sheets

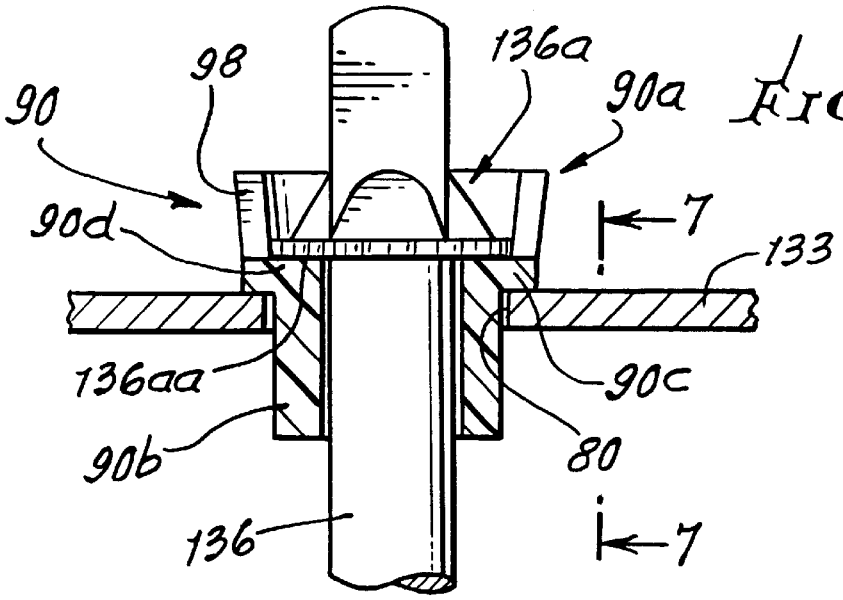
FIG. 6.
FIG. 7.
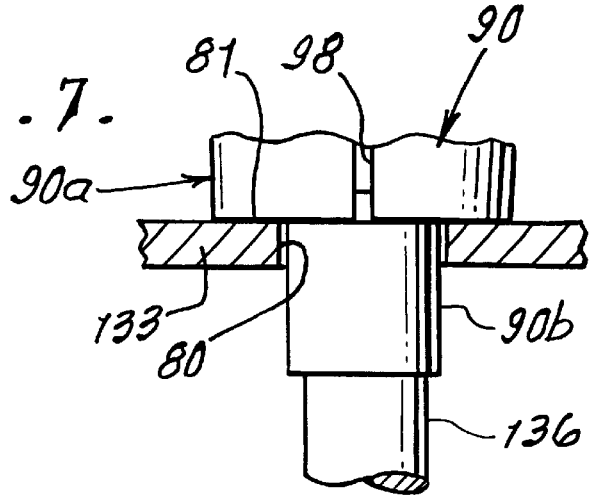
FIG. 8.
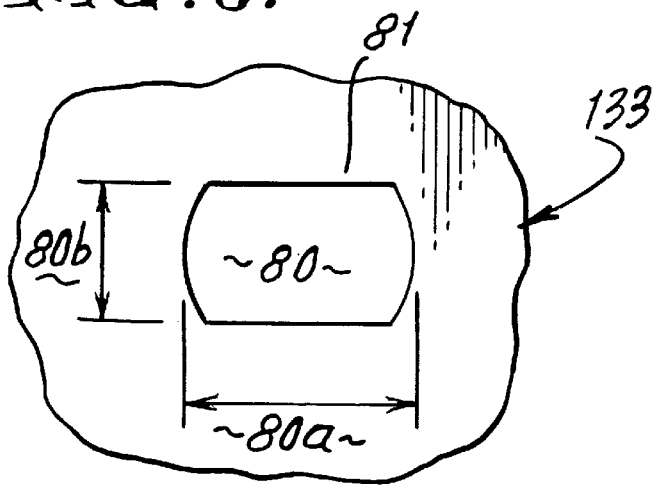

DRUM TENSIONER HOLDING

BACKGROUND OF THE INVENTION

This invention relates generally to drum structure, and more particularly to tensioner holding, preventing or blocking loosening of adjusted tensioner structure.

In the past, drum tensioner rods have been employed and adjusted to produce selected tensioning of drum heads. Such adjusting is typically effected by tightening rotating tensioner rods to produce desired drum head stretching, or tension. Such rotation adjusts the screw thread connection of the rods with lugs located at the outer side of the drum shell.

It is found that such tensioner rods can become loosened over time, due to repeated shock loading of the drum head, drum shell transmitted to the tensioner rods. Such impact loading facilitates unwanted rotation of the rods in loosening directions, and some rods can loosen more than others. There is need for a way to prevent or block such relative loosening of the rods, without preventing rotation adjustment of the rods to achieve desired stretching of the drum head for production of desired drum sounds, when struck.

SUMMARY OF THE INVENTION

It is a major object of the invention to provide tensioner rod holding, or holding structure, meeting the above need. In this regard, a drum typically includes a flange defining a through opening for passing the tensioner rod, the flange acting to tension the drum head. In this environment, the invention basically comprises:

a) a seating surface on the flange in close association with that opening, and b) a grommet to receive loading transmitted by the tensioner rod and having a shoulder or shoulders engaging the seating surface in such a way as to transmit loading to the flange, the grommet blocking loosening rotation of the tensioner rod, relative to the flange.

It is another object of the invention to provide a grommet as referred to, and wherein the shoulder or shoulders is or are tapered to receive a tensioner rod load transmitting shoulder. Multiple such wedging shoulders may be spaced about an axis defined by the grommet, and angled to resist loosening, rotation of serrations defined by the flange, but without preventing tensioner rod adjustment. Such individual multiple shoulders enhance the frictional effect that contributes to blocking of undesired loosening rotation of the tensioners.

An additional object is provision of multiple splits, in the grommet, and spaced about the grommet axis, to facilitate interfit of individual of the multiple grommet shoulders against the seating surface.

Yet another object is the provision of rod and grommet interengaged surfaces to transmit loading from the grommet to the flange when the rod is tightened. A drum lug to which the tensioner rod is threadably attached may be aligned with the grommet and spaced from it, to contribute with force direction to wedgeably seat the grommet, as referred.

A further object is to provide multiple of such grommets, for interaction with a series of tensioner rods spaced about the drum shell, and acting in concert to block unwanted changes in drum head adjusted tensioning.

These and other objects and advantages of the invention, as well as the details of an illustrative embodiment, will be more fully understood from the following specification and drawings, in which:

DRAWING DESCRIPTION

FIG. 6 is a section like that of FIG. 5, but showing the grommet in compressed condition, upon completion of installation;

FIG. 7 is an elevation taken-on lines 7—7 of FIG. 6; and

FIG. 8 is a plan view of a flange opening that receives the lower section of the grommet.

DETAILED DESCRIPTION

Figure 1:
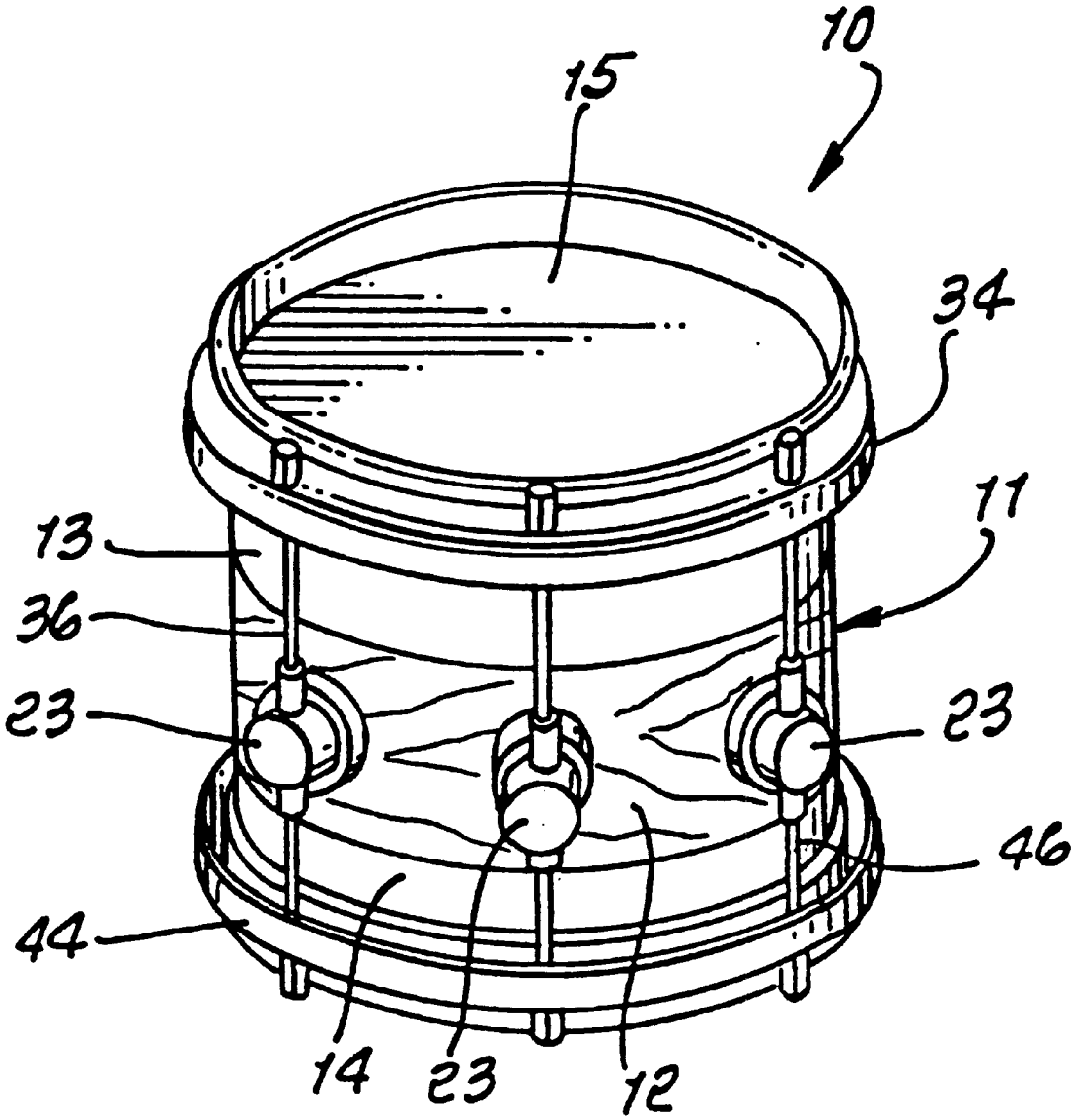
FIG. 1. PRIOR ART
FIG. 1 is a perspective view of a prior art drum.
Figure 2:
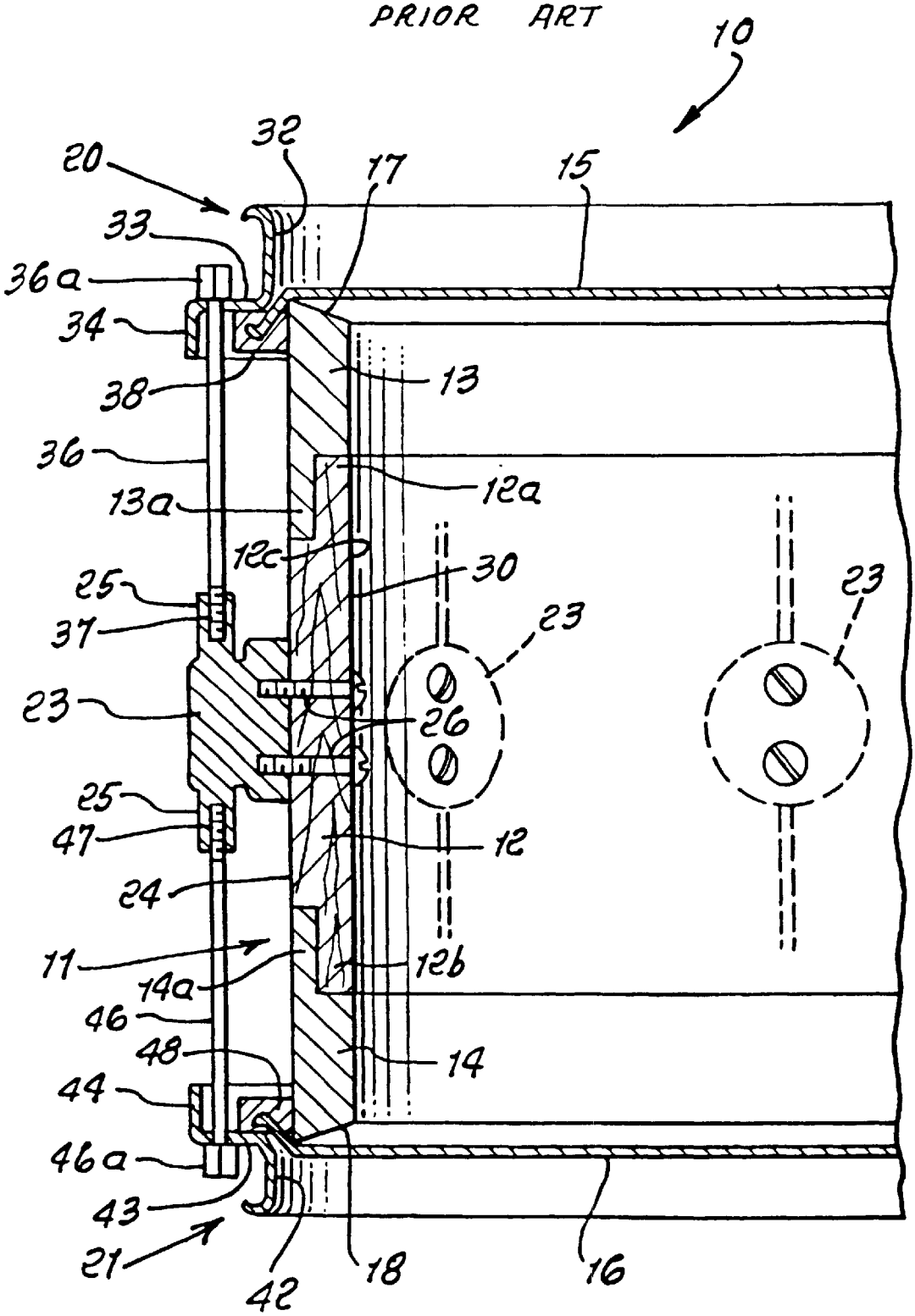
FIG. 2. PRIOR ART
FIG. 2 is a vertical section taken through one side of the FIG. 1 prior art drum.
Figure 3:
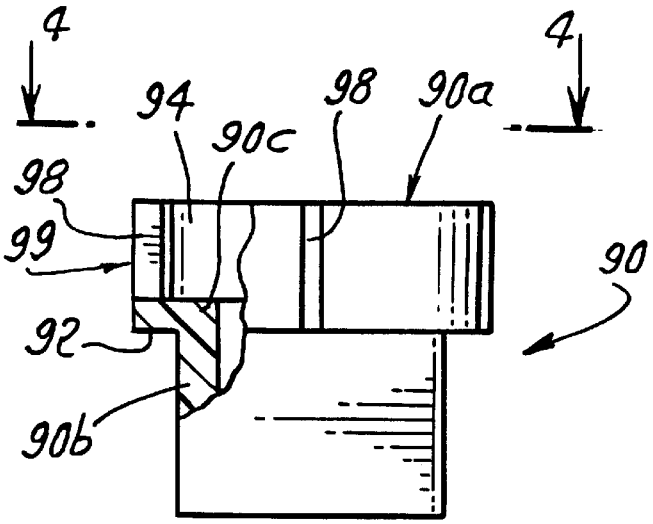
FIG. 3 is a side view of a grommet used for holding a tensioner rod.
Figure 5:
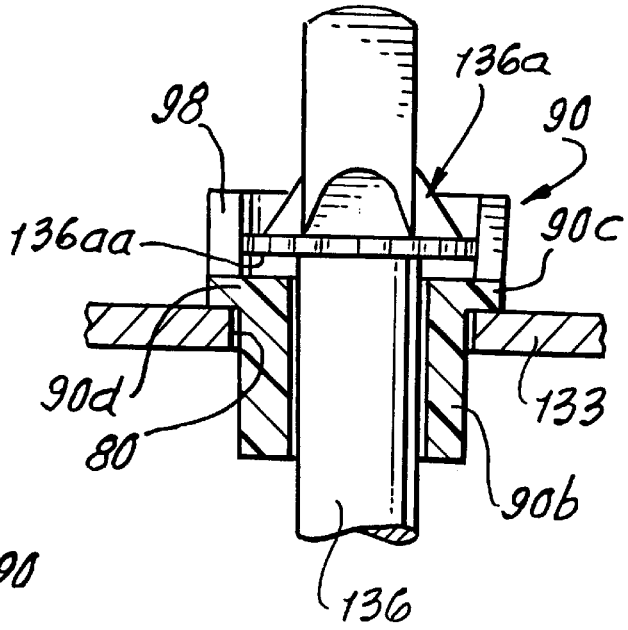
FIG. 5 is a section taken through a drum flange that passes and showing installation of the grommet.
Figure 4:
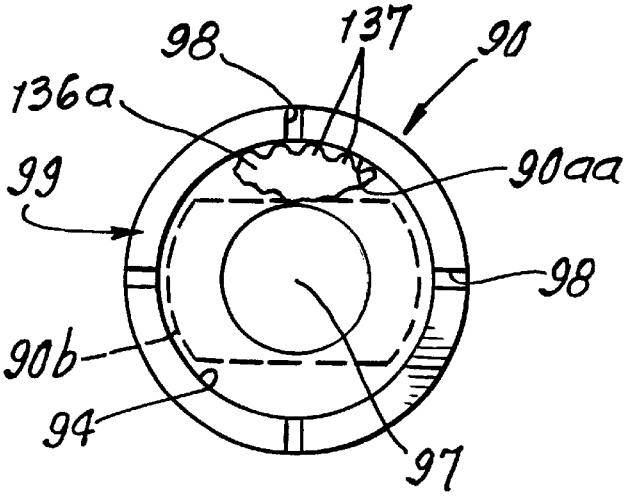
FIG. 4 is a top plan view of the FIG. 2 grommet.

In FIGS. 1 and 2, a prior art (see U.S. Pat. No. 5,377,576) drum 10 has a shell with cylindrical sections located in axially end-to-end position, at least a first section consisting of wood and at least second and third sections consisting of metal. In the example, the shell 11 has a first wall section 12 consisting of wood, a second wall section 13 consisting of metal, and a third wall section 14 consisting of metal. The section 12 is preferably located between sections 13 and 14, so that drumheads 15 and 16 may stretch over annular beveled metallic edges 17 and 18 that do "weather" or otherwise change with atmospheric or other conditions. For best results, sections 12 and 13 have telescopic interfit with section 11, as for example at radially overlapping portions 12*a* and 13*a*, and radially overlapping portions 12*b* and 14*a*. Such connections are also referred to as "pin and box" connections, providing high radial and axial stability. Sections 13 and 14 consist of brass, and section 12 of maple, and their interfits may be tight. A wall consisting of one material may be employed.

Means is also provided for retaining the drumhead means on the drum, including flange means at axial ends of the drum, retainer means on one of the sections, and adjustable tensioning means interconnecting the flange means and retainer means. In the example, flange structure 20 is provided in association with metal section 13 of the shell, and flange structure 21 in association with metal section 14 of the shell. Retainer elements 23 are spaced about and adjacent the outer surface 24 of wooden section 12, mid-way between metal sections 13 and 14, and the elements 23 may have circular cross sections as shown and consist of brass. The elements 23 carry tubular holders 25 projecting vertically and parallel to the drum axis, but in axially opposite directions. Tightening adjustment fasteners 26 project radially through the shell section 12 to affix the elements 23 to the outer surface of the section 12.

The upper flange structure 20 has an upwardly extending annular rim portion 32 extending above the level of drumhead 15, a medial annular flange portion 33 extending radially outwardly below the level of 32, for transmitting head tightening loading, and a lower annular portion 34 extending downwardly from the outer extent of 33. A tightening adjustment fastener or tensioner rod 36 extends downwardly through 33, and its lower end has external threads 37 that interfit rotatably internal threads in upper holder 25. Note fastener head 36*a* bearing on the upper surface of 33. The lower surface of 33 exerts downward loading onto a retention ring 38 to which drumhead 15 is suitably attached, for tightening (or loosening) same, by drawing the head over 17.

Likewise, lower flange structure 21 has a downwardly extending annular rim or flange portion 43 extending below the level of drumhead 16, a medial annular portion 44 extending radially outwardly above the level of 42 for transmitting head tightening loading, and an upper annular portion 44 extending upwardly from outer extent of 43. A tightening adjusting fastener or tensioner rod 46 extends upwardly through 42, and has external threads 47 that interfit rotatably the internal threads in lower holder 25. Note fastener head 46*a* bearing on the lower surface of 42. The upper surface of 43 exerts upward loading onto lower retention ring 48 to which drumhead 16 is suitably attached, for tightening (or loosening) same, i.e. over bevel 18. Accordingly, the drumheads are individually adjustable; however, it is found that the tensioner rods 36 and 46 can loosen as by rotation in untightening direction, during or as a result of drumming.

Referring now to FIGS. 3–8 a grommet 90 typically non-metallic, is provided to block loosening rotation of a tensioner rod 136 (corresponding to rod 36) relative to the drum head flange 133 (corresponding to flange 33). The flange defines a through opening 80 for passing the rod 136; and a seating surface 81 is located on the flange in close association with, i.e. extending about, the opening 80 opening 80 is elongated, and has length 80*a* and width 80*b*.

The grommet is cup-shaped and has upper wall section 90*a*, lower annular wall section 90*b*, and intermediate annular wall section 90*c*. The grommet is sized to receive axial loading transmitted by the tensioner rod during its adjustment to tension the drumhead 15. It has a shoulder or shoulders 92 to engage the seating surface 81 to transmit head tensioning loading to the flange 133 so as to cause the grommet to block loosening rotation of the tensioner rod, relative to flange. Elongation of lower wall section 90*b* fitting in elongated opening 80 prevents such relative rotation. The cup-shaped grommet upper section 90*a* defines a downwardly tapered wall, so as to provide an internal space 94 for reception of the tensioner rod head 136*a*. The latter has a load transmitting shoulder 136*aa* that engages the grommet upward facing shoulder 90*d*, as shown, to axially compress the grommet section 90*c* as seen in FIG. 6, and also to radially interfere with the grommet wall section 90*a*. Rod head 136*a* has circularly spaced serrations 137 that project outwardly and adjustably lock into the inner side 90*aa* of the walled section 90*a*.

The latter section 90*a* defines multiple wedging shoulders 99*aa* spaced about central axis 97 of the grommet, and angled as seen in FIGS. 6 and 7 to resist loosening rotation of the tensioner rod relative to the flange. Such wedging shoulders of the wall are defined by wall sections between axially extending splits 98 defined by the grommet, and also spaced about axis 97, whereby the wedging shoulders individually adjust, radially, to seating of the grommet at flange surface 81, to individually act to resist loosening of the tensioner rod, during use of the drum. The splits may extend to the grommet intermediate section 90*c*, and the splits extend, with taper, toward the seating surface 81.

The grommet may consist of hard elastomeric material, or of synthetic resin, i.e. hard, molded plastic material.

Grommets as described may be employed as described, in combination with each of the multiple upper and lower tensioner rods used about the drum periphery, as in FIGS. 1 and 2.

I claim:

1. For combination with drum head tensioning structure, including a flange defining a through opening for passing a tensioner rod, a) a seating surface on the flange in close association with said opening, and b) a grommet sized to receive loading transmitted by the tensioner rod, and having a shoulder or shoulders engaging said seating surface to transmit said loading to the flange, the grommet blocking loosening rotation of the tensioner rod relative to the flange, c) and wherein said grommet has a tapered wall extending about a grommet axis to provide space to receive a tensioner rod load transmitting shoulder.

2. The combination of claim 1 wherein said grommet wall includes multiple wedging shoulders spaced about said axis defined by the grommet, and angled to resist loosening rotation of serrations defined by the tensioner rod, relative to the flange.

3. The combination of claim 2 wherein there are multiple splits defined by the grommet and spaced about said axis, whereby said surfaces individually adjust to said seating.

4. The combination of claim 1 wherein the tensioner rod and grommet have interengaged surfaces to transmit said loading when the rod is tightened.

5. The combination of claim 1 including a drum, there being multiple of said tensioner rods spaced about the drum and passing through multiple through openings defined by the flange, and there being multiple of said grommets having load transmitting associations with said tensioner rods, as defined in claim 1.

6. The combination of claim 5 including multiple lugs spaced about the drum, each lug having screw thread connection with one of the tensioner rods, in aligned and spaced relation to a grommet through which the tensioner rod extends.

7. The combination of claim 1 including a lug having screw thread connection with the tensioner rod, in aligned and spaced relation to the grommet.

8. The combination of claim 1 wherein said grommet is non-metallic.

9. For combination with drum head tensioning structure, including a flange defining a through opening for passing a tensioner rod, a) a seating surface on the flange in close association with said opening, and b) a grommet sized to receive loading transmitted by the tensioner rod, and having a shoulder or shoulders engaging said seating surface to transmit said loading to the flange, the grommet blocking loosening rotation of the tensioner rod relative to the flange, c) and wherein said grommet defines an axis, and there being multiple splits defined by the grommet and spaced abut said axis, the grommet defining a central through opening for passing the tensioner rod.

10. For combination with drum head tensioning structure, including a flange defining a through opening for passing a tensioner rod, a) a seating surface on the flange in close association with said opening, and b) a grommet sized to receive loading transmitted by the tensioner rod, and having a shoulder or shoulders engaging said seating surface to transmit said loading to the flange, the grommet blocking loosening rotation of the tensioner rod relative to the flange, c) and wherein the grommet has cup-shape and defines a wedge shaped side wall, the grommet having a non-circular lower portion received in said flange through opening, which is also non-circular.

11. The combination of claim 10 wherein said side wall defines multiple splits.

12. The combination of claim 11 wherein the splits extend toward the seating surface.

13. The combination of claim 11 wherein the grommet consists of one of the following:

a) elastomeric material, b) synthetic resin.

* * * * *